US011313144B2

(12) United States Patent
Jeon

(10) Patent No.: US 11,313,144 B2
(45) Date of Patent: Apr. 26, 2022

(54) SEISMIC REINFORCEMENT STRUCUTRE AND SEISMIC RETROFITTING METHOD

(71) Applicant: TRAUM WOOD HOUSE Corp., Sejong-si (KR)

(72) Inventor: Jae Hwan Jeon, Sejong-si (KR)

(73) Assignee: TRAUM WOOD HOUSE CORP., Sejong-si (KR)

( * ) Notice: Subject to any disclaimer, the term of this patent is extended or adjusted under 35 U.S.C. 154(b) by 200 days.

(21) Appl. No.: 16/747,583

(22) Filed: Jan. 21, 2020

(65) Prior Publication Data

US 2020/0248470 A1 Aug. 6, 2020

(30) Foreign Application Priority Data

Feb. 1, 2019 (KR) ..... 10-2019-0013366

(51) Int. Cl.
*E04H 9/02* (2006.01)
*E01C 11/18* (2006.01)
*E04B 1/98* (2006.01)

(52) U.S. Cl.
CPC ..... *E04H 9/021* (2013.01); *E01C 11/18* (2013.01); *E04B 1/98* (2013.01)

(58) Field of Classification Search
CPC .... E04B 1/98; E04B 2001/3583; E04C 11/18; E04H 9/021; E04H 9/0215; E04H 9/0235; E04H 9/0237; E04H 9/14; E04H 9/027
USPC ..... 52/167.4
See application file for complete search history.

(56) References Cited

U.S. PATENT DOCUMENTS 4,699,547 A * 10/1987 Seegmiller ..... E21D 11/006 405/259.1
5,115,615 A * 5/1992 Miyake ..... E04B 1/98 248/638
5,185,976 A * 2/1993 Miyake ..... F16F 13/007 52/167.6
5,491,935 A * 2/1996 Coxum ..... E04H 9/14 52/92.2
5,531,054 A * 7/1996 Ramirez ..... E04H 9/14 52/741.1

(Continued)

FOREIGN PATENT DOCUMENTS

JP H09-189076 A 7/1997
JP 2001-317125 A 11/2001

(Continued)

*Primary Examiner* — Brian E Glessner
*Assistant Examiner* — James J Buckle, Jr.
(74) *Attorney, Agent, or Firm* — KORUS Patent, LLC; Seong Il Jeong

(57) ABSTRACT

Disclosed is a seismic reinforcement structure and a seismic retrofitting method, including: a first bracket including a horizontal part extending in contact with the bottom surface of the building, and a vertical part formed in connection with the horizontal part and extending in contact with the wall surface of the building; a second bracket including a horizontal part extending in contact with the ceiling of the building, and a vertical part formed in connection with the horizontal part and extending in contact with the wall surface of the building; and a connecting support rod having a vertically long shape and vertically connecting the horizontal part of the first bracket and the second bracket, wherein the relative position to the bottom of the whole building is fixed, thereby preventing the building from collapsing.

12 Claims, 9 Drawing Sheets

(56) References Cited

U.S. PATENT DOCUMENTS 5,761,863 A * 6/1998 Sutt, Jr. ..... E04H 9/14 52/272
5,832,679 A * 11/1998 Roth ..... E04H 9/0237 52/167.3
6,427,391 B1 * 8/2002 Lyons ..... E04B 1/003 52/236.6
6,560,940 B2 * 5/2003 Mueller ..... E04B 1/2604 411/536
6,843,027 B2 * 1/2005 Gaddie ..... E04H 9/14 52/92.1
7,299,593 B1 * 11/2007 diGirolamo ..... E04B 2/58 52/241
7,665,257 B2 * 2/2010 Posey ..... E04B 1/26 52/223.13
7,971,411 B2 * 7/2011 Commins ..... E04H 9/14 52/745.21
8,079,188 B2 * 12/2011 Swartz ..... E04H 9/10 52/281
8,215,068 B2 * 7/2012 Bongiorno ..... E04C 5/07 52/167.8
8,356,449 B2 * 1/2013 Lin ..... E04B 1/2604 52/293.3
8,434,281 B2 * 5/2013 Halfon ..... E06B 3/4636 52/291
8,511,025 B2 * 8/2013 Kawai ..... E04B 1/681 52/393
8,925,267 B1 * 1/2015 Kirby ..... E04G 23/0218 52/291
9,091,056 B2 * 7/2015 Stauffer ..... E04B 1/40
9,097,000 B2 * 8/2015 Espinosa ..... E04B 1/40
9,874,009 B2 * 1/2018 Espinosa ..... E04B 2/56
11,136,754 B2 * 10/2021 Espinosa ..... E02D 27/34
2003/0136075 A1 * 7/2003 Brackett ..... E04H 9/14 52/712
2003/0230032 A1 * 12/2003 Shahnazarian ..... E04H 9/14 52/167.3
2004/0118053 A1 * 6/2004 Huppert ..... E04B 1/2604 52/23
2005/0193681 A1 * 9/2005 Brackett ..... E04H 9/028 52/698
2011/0041449 A1 * 2/2011 Espinosa ..... E04B 1/4157 52/698
2012/0304589 A1 * 12/2012 Commins ..... E04B 1/2604 52/745.21
2014/0090315 A1 * 4/2014 Imai ..... E04B 1/49 52/167.1
2015/0204369 A1 * 7/2015 Crumley ..... E04H 9/14 411/10
2016/0369499 A1 * 12/2016 Crumley ..... E04H 9/14
2017/0030701 A1 * 2/2017 Saxey ..... G01B 7/18
2017/0058514 A1 * 3/2017 Wu ..... E04H 9/021
2017/0089063 A1 * 3/2017 Espinosa ..... E04H 9/021
2020/0102751 A1 * 4/2020 Guo ..... E04C 5/165
2021/0310267 A1 * 10/2021 Espinosa ..... E04H 9/14

FOREIGN PATENT DOCUMENTS

JP 2005-016102 A 1/2005
KR 10-1137236 B1 4/2012
KR 10-1704361 B1 2/2017
KR 10-2017-0055501 A 5/2017

* cited by examiner

* Dynamic Spring Rate of Leaf Spring (kgf/mm)

| 변위 / 하중 | ± 5mm | | ± 10mm | | ± 15mm | | ± 20mm | |
|---|---|---|---|---|---|---|---|---|
| | Test | FEM | Test | FEM | Test | FEM | Test | FEM |
| 800 kgf | 25.1 | 25.4 | 23.6 | 23.9 | 22.6 | 22.8 | 22.4 | 22.5 |
| 1200 kgf | 26.3 | 26.8 | 24.7 | 24.9 | 23.1 | 23.5 | 22.5 | 23.1 |
| 1600 kgf | 27.4 | 28.3 | 25.4 | 26.0 | 23.9 | 24.5 | 23.0 | 23.7 |
| 2000 kgf | 28.9 | 30.2 | 26.4 | 27.0 | 24.7 | 25.2 | 23.5 | 24.1 |

FEM: Static finite element analysis

FIG. 3

SEISMIC REINFORCEMENT STRUCUTRE AND SEISMIC RETROFITTING METHOD

TECHNICAL FIELD

The present disclosure relates to a seismic reinforcement, and more particularly, to a seismic reinforcement structure and a seismic retrofitting method that can be installed in a building of lightweight wooden structure or the like to improve seismic resistance.

BACKGROUND ART

An earthquake is a phenomenon in which the energy inside the earth comes out to the surface and the ground splits and shakes, and the shaking that occurs at this time acts as a load on the building and causes a great deal of damage to the building. For this reason, in South Korea, seismic design is mandatory in high-rise buildings with three or more floors or more than 500 $m^3$, and laws and legislations have been strengthened that after the 2016 Gyeongju earthquake and the 2017 Pohang earthquake, seismic design is mandatory in all wood-structured houses, including a single-family house, regardless of floor or area.

Conventionally, many techniques for improving seismic resistance have been developed in order for buildings to satisfy seismic design standards. As an example, in the Korean Unexamined Patent Publication No. 10-2017-0055501, a damper was installed on the building so as to absorb vibration energy caused by an earthquake.

However, the conventional seismic resistance improvement technology as described above is applicable only when the target building is a heavy building. Seismic reinforcement structures to improve the seismic resistance is also heavy and expensive, and there was a limit to its application to lightweight wooden buildings. In addition, it has been more than 30 years since the American lightweight wooden house construction method was introduced in Korea, but there is almost no seismic reinforcement technology suitable for the characteristics of the Korean morphostructure. Accordingly, there is an urgent need to develop a seismic reinforcement structure that can be applied even to light weight wooden buildings.

PRIOR ART LITERATURE

Patent Literature (Patent Literature 1] 1. Korean Unexamined Patent Publication No. 10-2017-0055501 ("Inter-element joint structure")

[Patent Literature 2] 2. Korean Registered Patent No. 10-1137236 ("Seismic reinforcement construction method of building using seismic reinforcing device")

(Patent Literature 3] 3. Korean Registered Patent No. 10-1704361 ("Reinforcement method and reinforcement structure of ground equipments with reinforced seismic performance by variable bracket")

DETAILED DESCRIPTION OF THE PRESENT DISCLOSURE

Technical Problem

The present disclosure has been designed to solve the above-mentioned problems, and it is an object of the present disclosure to provide a lightweight and economical seismic reinforcement structure applicable to a lightweight wooden building.

On the other hand, the object of the present disclosure is not limited to the object mentioned above, other objects that are not mentioned will be clearly understood from the following description.

Technical Solution

The seismic reinforcement structure of a wooden structure building according to one preferred embodiment of the present disclosure includes: a first bracket including a horizontal part extending in contact with the bottom surface of the building, and a vertical part formed in connection with the horizontal part and extending in contact with the wall surface of the building; a second bracket including a horizontal part extending in contact with the ceiling of the building, and a vertical part formed in connection with the horizontal part and extending in contact with the wall surface of the building; and a connecting support rod having a vertically long shape and vertically connecting the horizontal part of the first bracket and the second bracket.

Further, each of the first bracket and the second bracket connects a horizontal portion and a vertical portion, and a curved surface portion formed with a predetermined radius of curvature is further formed.

Here, when the length in the first direction in which the horizontal parts of the first bracket and the second bracket are extended is set up to be L1, the length in the second direction in which the vertical parts are extended is set up to be L2 and the radius of curvature of the curved surface portion is set up to be R, the L2 is formed with a length of 1.5L1 or more and 4L1 or less, and the R is formed with 0.1L1 or more and 0.5L1 or less.

Further, the curved surface portion is characterized in that the width or thickness is formed to be smaller than the horizontal part or the vertical part.

Further, the connecting support rod includes: a plurality of screw rods which are formed in a vertically long shape, have a male screw formed on the outer surface, and are arranged in succession to each other in the vertical direction; and a connector which has a tubular shape, has a female screw formed on an inner peripheral surface thereof, and is screw-coupled by the screw rod arranged in succession to each other at both ends, so that the length and tension can be adjusted.

Further, the connecting support rod vertically penetrates the horizontal parts of the first bracket and the second bracket, and the ceiling of the building, so that an upper end is fixed to the ceiling and a lower end is inserted into a bottom surface of the building; and the seismic reinforcement structure is provided so as to surround a lower end of the connecting support rod at a portion where the lower end of the connecting support rod of the bottom of the building is inserted, and further includes an anchor for fixing the connecting support rod.

Alternatively, the seismic reinforcement structure further includes: an anchor composed of an insertion part having a predetermined shape and embedded in the bottom, and a protrusion extending upwardly from the insertion part and vertically protruding the first bracket to protrude upwardly from the bottom surface; and the connecting support rod vertically penetrates a horizontal part of the second bracket and a ceiling of the building, so that an upper end is fixed to the ceiling and a lower end is connected to the upper part of the protrusion portion.

Further, the building includes two or more floors, the first bracket and the second bracket being installed on each floor; and the connecting support rod is configured so that the upper end penetrates the second bracket of the uppermost floor and is fixed to the ceiling, the lower end is fixed to the anchor provided at the bottom of the lowermost floor, and the central part penetrates at least the brackets excluding the second bracket of the uppermost floor and the first bracket of the lowermost floor.

On the other hand, a seismic retrofitting method according to one preferable embodiment of the present disclosure for constructing the seismic reinforcement structure, the method comprising the steps of: 1) arranging a steel reinforcement to be included in a bottom of the building; 2) fixing an insertion part to the steel reinforcement so that the protrusion of the anchor protrudes at a position where the first bracket is installed; 3) placing concrete so that the steel reinforcement and the insertion part are embedded, thereby forming the bottom of the building; 4) forming the wall surface and the ceiling on the upper side of the bottom to construct a building; 5) inserting the protrusion into a through hole formed in the horizontal part of the first bracket, then fixing the first bracket to the bottom and the wall surface, and fixing the second bracket to the ceiling and the wall surface so as to face the first bracket; and 6) penetrating and fixing an upper end of the connecting support rod to the horizontal part of the second bracket and the ceiling, and connecting a lower end of the connecting support rod to the protrusion.

At this time, when two or more floors are included in the building, in step 4), a wall surface, a ceiling and a bottom are additionally constructed on the upper side of the bottom so as to correspond to the number of floors included in the building; in step 5), the first bracket and the second bracket are fixed at a position facing each other on each floor, but the first bracket and the second bracket included in each floor is arranged on the same line each other, and in the case of the lowermost floor, the protrusion is inserted into a through hole formed in a horizontal part of the first bracket; and in step 6), the upper end of the connecting support rod is fixed through the horizontal part of the second bracket and the ceiling of the uppermost floor, and the lower end of the connecting support rod is connected to the protrusion of the lowermost floor.

Alternatively, the method of the present disclosure includes the steps of: a) forming an anchor groove by drilling a position where the first bracket is installed at the bottom of the building; b) injecting a liquid chemical anchor into the anchor groove; c) fixing the first bracket to the bottom and the wall surface, and fixing the second bracket to the ceiling and the wall surface so as to face the first bracket; d) inserting a lower end of the connecting support rod into the anchor groove through a horizontal part of the first bracket and solidifying the chemical anchor; and e) fixing the upper end of the connecting support rod through the horizontal part of the second bracket and the ceiling.

At this time, when two or more floors are included in the building, in step a), an anchor groove is formed only at the bottom of the lowermost floor of the building, in step c), the first bracket and the second bracket are fixed to positions facing each other on each floor, but the first bracket and the second bracket included in each floor are disposed on the same line each other, and in step e), the upper end of the connecting support rod is fixed through the horizontal part of the second bracket and the ceiling on the uppermost floor.

Advantageous Effects

The seismic reinforcement structure and the seismic retrofitting method of the present disclosure based on the configuration as described above are effective to support left and right vibration by supporting between the wall surface and the bottom surface or between the wall surface and the ceiling through the configuration of the bracket.

In particular, the vertical part elastically supports the wall surface with respect to the horizontal part by the shape characteristic of the curved surface portion, so that it is effective to absorb vibration in the left and right directions and improve the seismic resistance.

In addition, through the ratio of the length between the horizontal part and the vertical part, the wall surface can be effectively supported even when a large load is not applied to the horizontal part.

Moreover, by keeping a separation distance constant between the ceiling and the bottom through the structure of the connecting support rod, it is effective to disperse the load concentrated on the support and the wall surface when the vertical vibration occurs.

Further, through the configuration of the connecting support rod composed of a screw rod and a connector, the length can be adjusted and customization can be applied to the building of various heights, and it is effective to adjust the tension applied between the ceiling and the bottom.

Further, the connecting support rod is fixed to the bottom of the building via the configuration of the anchor, and the relative position of the bottom of the whole building is fixed, so that the building can be prevented from collapsing.

BRIEF DESCRIPTION OF THE DRAWINGS

FIG. 3 is a diagram showing a change in a spring rate of the flat spring made of the same material as the bracket.

DETAILED DESCRIPTION OF THE EMBODIMENTS

Preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Therefore, the description proposed herein is just a preferable example for the purpose of illustrations only, not intended to limit the scope of the disclosure, so it should be understood that other equivalents and modifications could be made thereto without departing from the spirit and scope of the disclosure.

Hereinafter, the technical idea of the present disclosure will be described in more detail with reference to the accompanying figures. The accompanying figures are only examples for explaining the technical idea of the present disclosure in more detail and the technical idea of the present disclosure is not limited to the form of the accompanying figures.

[Seismic Reinforcement Structure]

Figure 1:
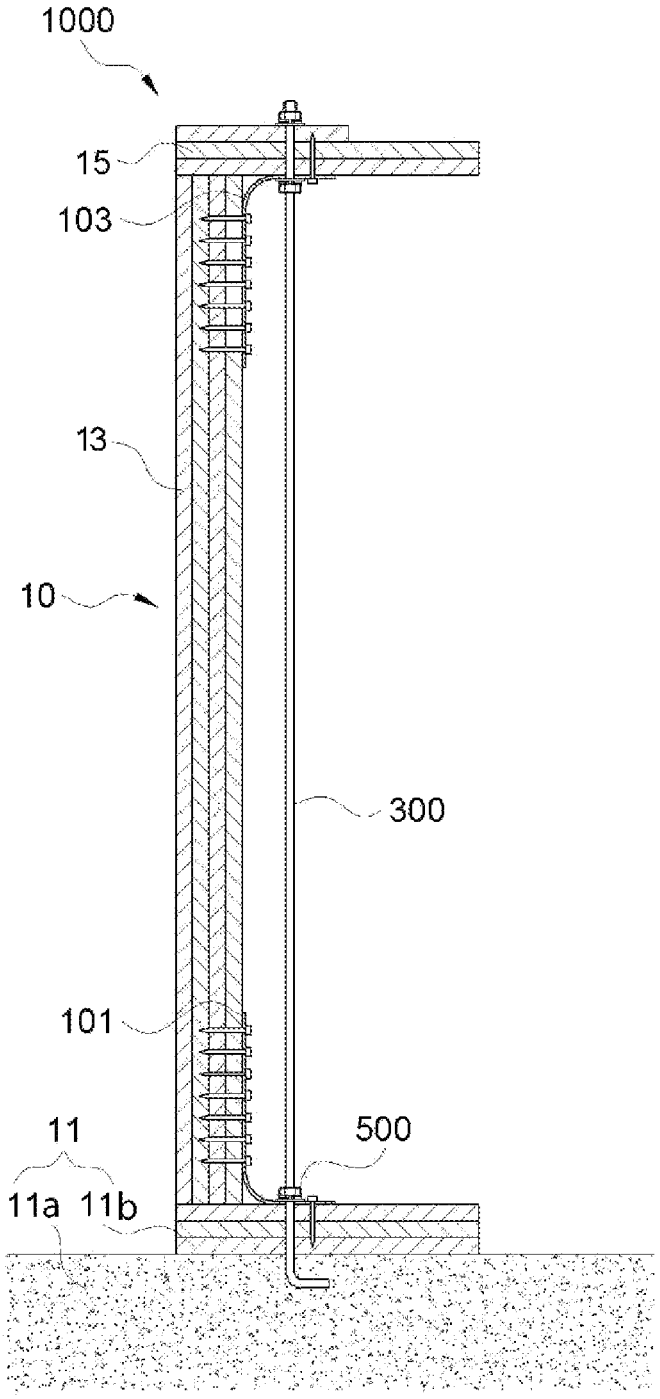
FIG. 1 is a side cross-sectional view showing a state in which the seismic reinforcement structure according to a preferred embodiment of the present disclosure is installed in a single-story building.

FIG. 1 is a side cross-sectional view showing a state in which the seismic reinforcement structure according to a preferred embodiment of the present disclosure is installed in a building.

As shown in FIG. 1, the seismic reinforcement structure 1000 according to a preferred embodiment of the present disclosure is to be applied to a lightweight wooden building 10 to improve the seismic resistance of the building 10, and it largely includes a first bracket 101, a second bracket 103, an anchor 500, and a connecting support rod 300.

Prior to describing the configuration of each part, the structure of the building 10 to which the seismic reinforcement structure 1000 according to the preferred embodiment of the present disclosure can be applied will be briefly described. The building 10 includes a bottom 11 consisting of a first bottom layer 11*a* made of concrete in which a steel reinforcement is arranged inside the ground, and a second bottom layer 11*b* made of lightweight wood laminated on the upper side thereof; a wall surface 13 which is perpendicularly raised and installed to the bottom 11 so as to form a predetermined space on the upper side of the bottom 11; and a ceiling 15 which covers the upper part of the space surrounded by the wall surface 13 and is installed so as to make contact perpendicular to the wall surface 13.

The first bracket 101 is installed at a portion where the bottom 11 and the wall surface 13 are in contact each other, and serves to support the wall surface 13 when the wall surface 13 shakes in the left and right directions due to an earthquake or the like. The second bracket 103 is installed at a portion where the ceiling 15 and the wall surface 13 contact each other, and the second bracket 103 also serves to support the wall surface 13 when the wall surface 13 shakes in the left and right directions due to an earthquake or the like.

Figure 2:
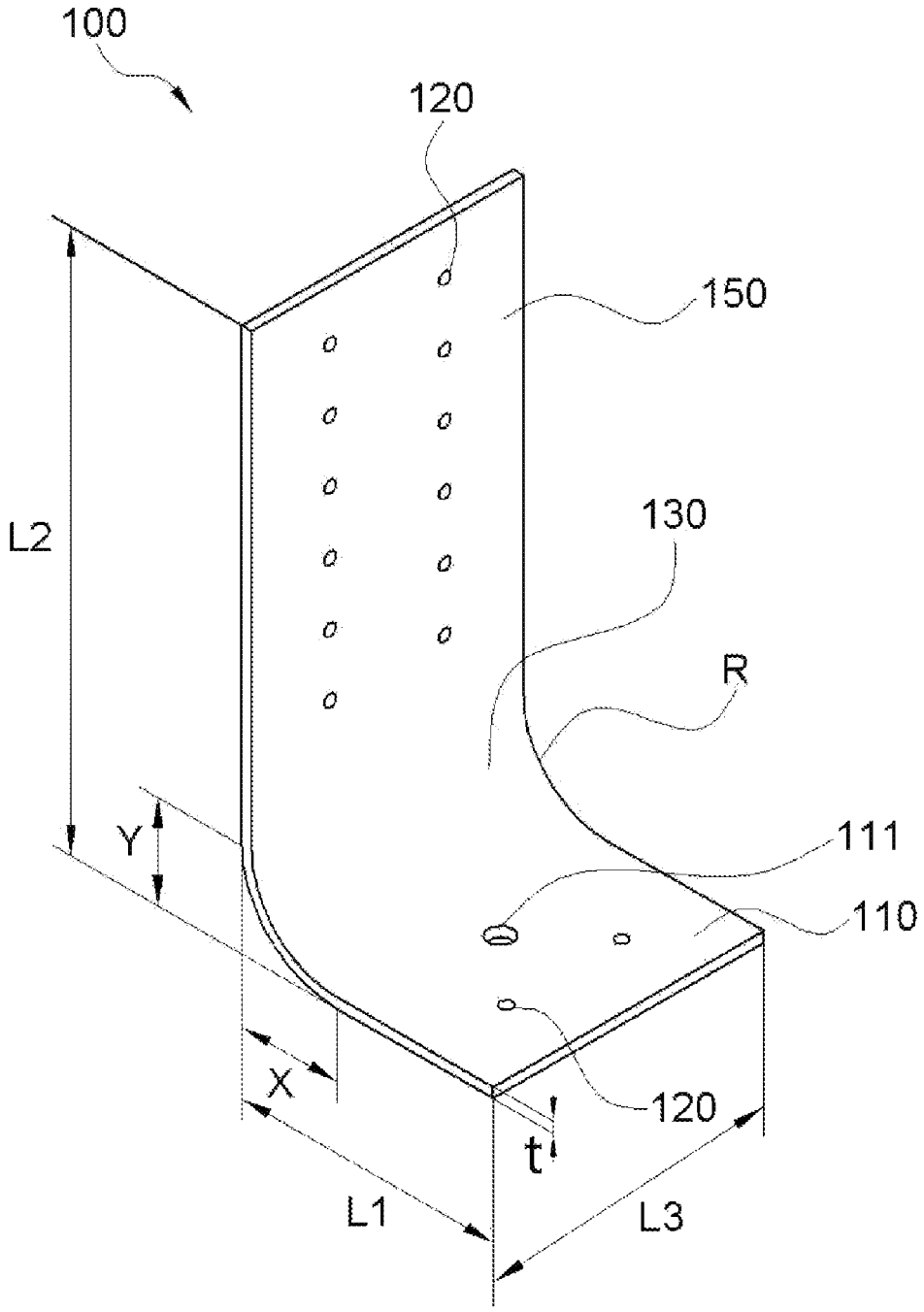
FIG. 2 is a perspective view illustrating a state of a first bracket or a second bracket.

FIG. 2 is a perspective view illustrating a state of a first bracket or a second bracket.

The first bracket 101 and the second bracket 103 are formed in the same shape each other. Therefore, in the following, the first bracket 101 and the second bracket 103 are collectively referred to as a bracket 100, and the shape will be described together with each other with reference to FIG. 2. The bracket 100 is formed to include a horizontal part 110, a vertical part 150, and a curved surface portion 130. The horizontal part 110 and the vertical part 150 are each formed in a form extended by a predetermined length, wherein each of them is connected to each other vertically, and is connected to each other between the vertical part 150 and the horizontal part 110, and a curved surface portion 130 connected to each other and formed with a predetermined radius of curvature (R) is formed.

The horizontal part 110 is a part in contact with the bottom surface or the ceiling of the building, and the vertical part 150 is a part in contact with the wall surface. When the extending direction of the horizontal part 110 is set up to be a first direction, and the length in the first direction of the bracket 100 is set up to be L1, the length L2 in the second direction, which is an extension direction of the vertical part 150, is formed to be 1.5L1 or more and 4L1 or less. Preferably, it is preferably formed to be 1.7L1 or more and 3.2L1 or less, more preferably 1.9L1 or more and 2.1L1 or less. The above-mentioned length ratio of the length L1 in the first direction of the bracket 100 and the length L2 in the second direction is a value considering the problem that, when the length L2 in the second direction is too long compared to the length L1 in the first direction, the load acting on the horizontal part 110 increases and thus it can be easily broken, conversely, when the length L1 in the second direction is too short, it cannot support the load applied from the wall surface, and the wall surface easily collapses when vibration in the left and right directions occurs.

In addition, the length L3 in the width direction of the bracket 100, that is, the third direction which is a direction perpendicular to the first direction and the second direction, is formed preferably in the range of 0.1L1 or more and 0.4L1 or less, preferably 0.2L1 or more and 0.3L1 or less, more preferably 0.22L1 or more and 0.25L1 or less when the length in the first direction of the bracket 100 is L1. The thickness t of the bracket 100 is formed preferably in the range of 0.1L3 or more and 0.2L3 or less, preferably 0.12L3 or more and 0.15L3 or less, and more preferably 0.13L3 or more and 0.14L3 or less.

On the other hand, the material of the bracket 100 is made of SK3 carbon tool steel. More precisely, it is preferable that the reference code in KS D3751 is STC105 (STC3) and the reference code in JIS4401 is a carbon tool steel which is SK3(SK105) grade. At this time, as the chemical composition of the bracket 100, when C nominal is 1, C (carbon) is 1.00 to 1.10, Si (silicon) is 0.10 to 0.35, Mn (manganese) is 0.10 to 0.50, P (phosphorus) is 0.03, S (sulfur) is 0.03, Cr (chromium) is 0.50 to 1.00, W (tungsten) is 0.50 to 1.00. Heat treatment at 750 to 780° C. is easy to increase impact resistance and abrasion resistance. In addition, if the rust preventive treatment is performed after the heat treatment, it is possible to prevent the occurrence of rust and corrosion. FIG. 3 illustrates the change in the spring rate through the elasticity test of the flat spring made of the same material as described above. The dimension of the length L3 and the thickness t of the bracket 100 in the third direction is a dimension that can have the maximum elasticity and strength in the curved surface portion 130 when the bracket 100 is made of SK3 carbon tool steel.

Figure 4:
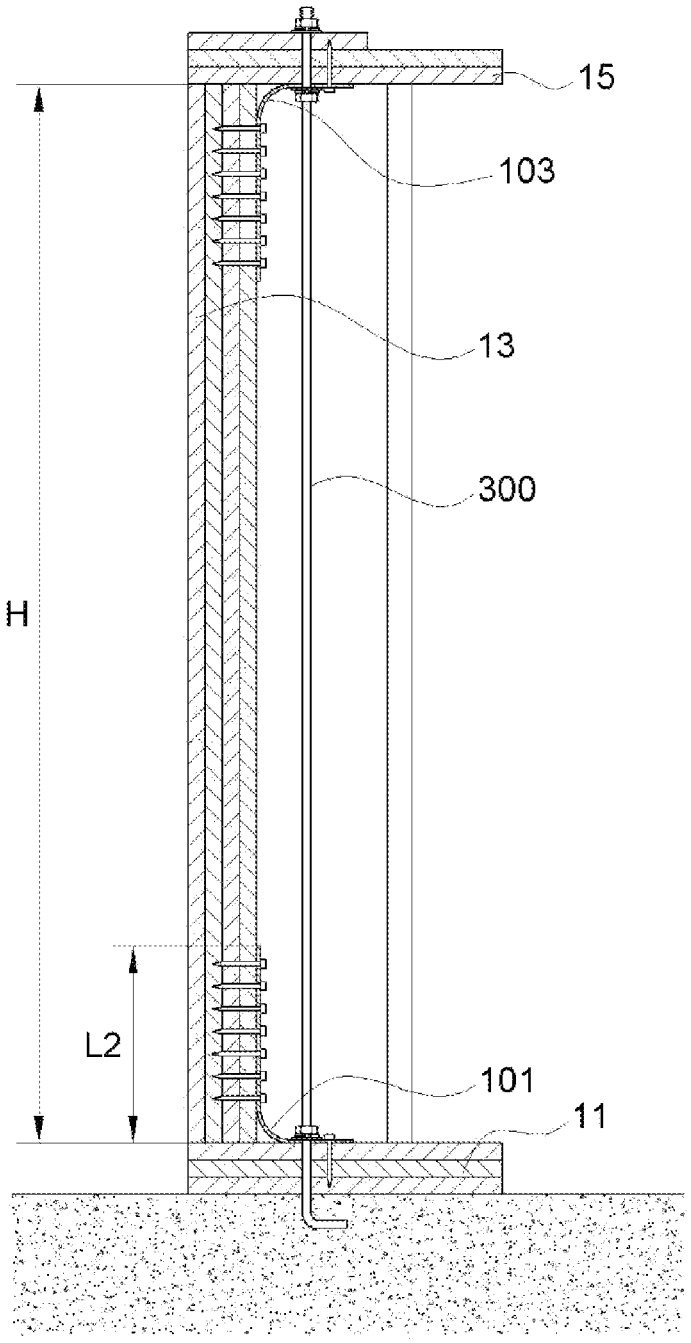
FIG. 4 is a side cross-sectional view showing a state in which the first bracket and the second bracket are installed in the building.

FIG. 4 is a side cross-sectional view showing a state in which the first bracket and the second bracket are installed in the building.

Referring briefly to FIG. 4, when the height of the wall surface 13 of the building is H, the length L2 in the second direction is preferably formed to be 0.1H or more and 0.4H or less, preferably 0.1H or more and 0.2H or less, most preferably 0.125H.

Referring again to FIG. 2, the shape of the curved surface portion 130 will be described. As described above, the curved surface portion 130 is formed so as to connect the horizontal part 110 and the vertical part 150 to each other, and has a predetermined radius of curvature R. At this time, the radius of curvature R is formed in the range of 0.1L1 or more and 0.5L1 or less. Preferably, it is formed in the range of 0.2L1 or more and 0.3L1 or less, more preferably, 0.2L1 or more and 0.25L1 or less. Further, the length in the first direction of the curved surface portion 130 is formed in the range of 0.1L1 or more and 0.7L1 or less, preferably 0.3L1 or more and 0.6L1 or less, most preferably 0.4L1 or more and 0.5L1 or less, and the length in the second direction of the curved surface portion 130 is 0.1L2 or more and 0.5L2 or less, preferably 0.2L2 or more and 0.4L2 or less, and most preferably 0.2L2 or more and 0.3L2 or less. In the bracket 100 included in the seismic reinforcement structure according to the preferred embodiment of the present disclosure, the radius of curvature R of the curved surface portion 130, and the length in the first direction and the second direction of the curved surface portion 130 are formed in the above-mentioned range, whereby the stress concentration phenomenon at the connecting portion of the horizontal part 110 and the vertical part 150 is reduced and thus it exhibits the effect that is not easily broken when vibration occurs in left and right directions.

When the first bracket 101 and the second bracket 103 are installed in a building, the first bracket 101 has a form in which a horizontal part 110 is extended in contact with the bottom surface of the building, the vertical part 150 is installed so as to extend in contact with the wall surface, the second bracket 103 has a form in which the horizontal part 110 is extended in contact with the ceiling, and the vertical part 150 is installed so as to extend in contact with the wall surface.

In addition, the horizontal part 110 of the first bracket 101 and the horizontal part 110 of the second bracket 103 are arranged so that they are located on the same line each other in the vertical direction when installed in the building.

In the horizontal part 110, a through-hole 111 into which a connecting support rod or an anchor described later is inserted is formed. The formation position of the through hole 111 is formed on the side where the curved surface portion 130 is formed based on the first direction, it is formed at the center of the horizontal part 110, that is, at a point of 0.5L3 based on the third direction, and the diameter of the through hole 111 is preferably formed in the range of 0.2L3 or more and 0.25L3 or less. For example, when the length L3 in the third direction of the bracket is formed to be 90 mm, the diameter of the through hole 111 is about 18 mm or more and 22.5 mm or less, most preferably 20 mm.

For reference, the first bracket 101 and the second bracket 103 are previously explained as being arranged so that each horizontal part 110 is disposed on the same line each other in the vertical direction when installed in the building, However, more precisely, it is preferable that the through hole 111 of the first bracket 101 and the through hole 111 of the second bracket 103 are arranged so as to be located on the same line each other in the vertical direction.

The horizontal part 110 and the vertical part 150 of each of the first bracket 101 and the second bracket 103 are fixed to the bottom surface, the wall surface, and the ceiling through a piece (not shown). To this end, a piece hole 120 is formed in each of the horizontal part 110 and the vertical part 150. The piece holes 120 are formed in pairs in a third direction, that is, in a width direction, and are formed in the size of 0.07L3 or more and 0.075L3 or less in diameter. For example, when L3 is 90 mm, the diameter of the piece hole 120 is 6.3 mm or more and 6.75 mm or less, preferably 6.5 mm.

In detail, the position of the piece hole 120 formed in the horizontal part 110 is a point spaced apart by a length of 0.7L1 or more and 0.9L1 or less in the first direction with respect to the side where the vertical part 150 is formed. More precisely, it is formed at a point separated by 0.8L1. When the piece hole 120 is formed too close to the curved surface portion 130, the bracket 100 does not move flexibly when vibration in the left and right directions occurs, thereby preventing the problem of reducing the seismic resistance. In doing so, the through hole 111 is formed so that the connecting support rod described later allows distribution of a load applied to the piece to be fastened to the piece hole 120.

The piece hole 120 formed in the vertical part 150 also starts at a point spaced by 0.25L2 in the second direction based on the side on which the horizontal part 110 is formed for the same reason as the piece hole 120 formed in the horizontal part 110, and the piece holes 120 are formed at intervals of 0.125L2 in the second direction, wherein the number of piece holes 120 formed in the vertical part 150 is formed in one pair or more and six pairs or less. This is a value considering that the maximum number of pieces that can be inserted into the piece hole 120 is 12 within a range not affecting the fatigue degree of the bracket 100. For reference, it goes without saying that the number of the piece holes 120 formed in the vertical part 150 is most preferably six pairs.

Figure 6:
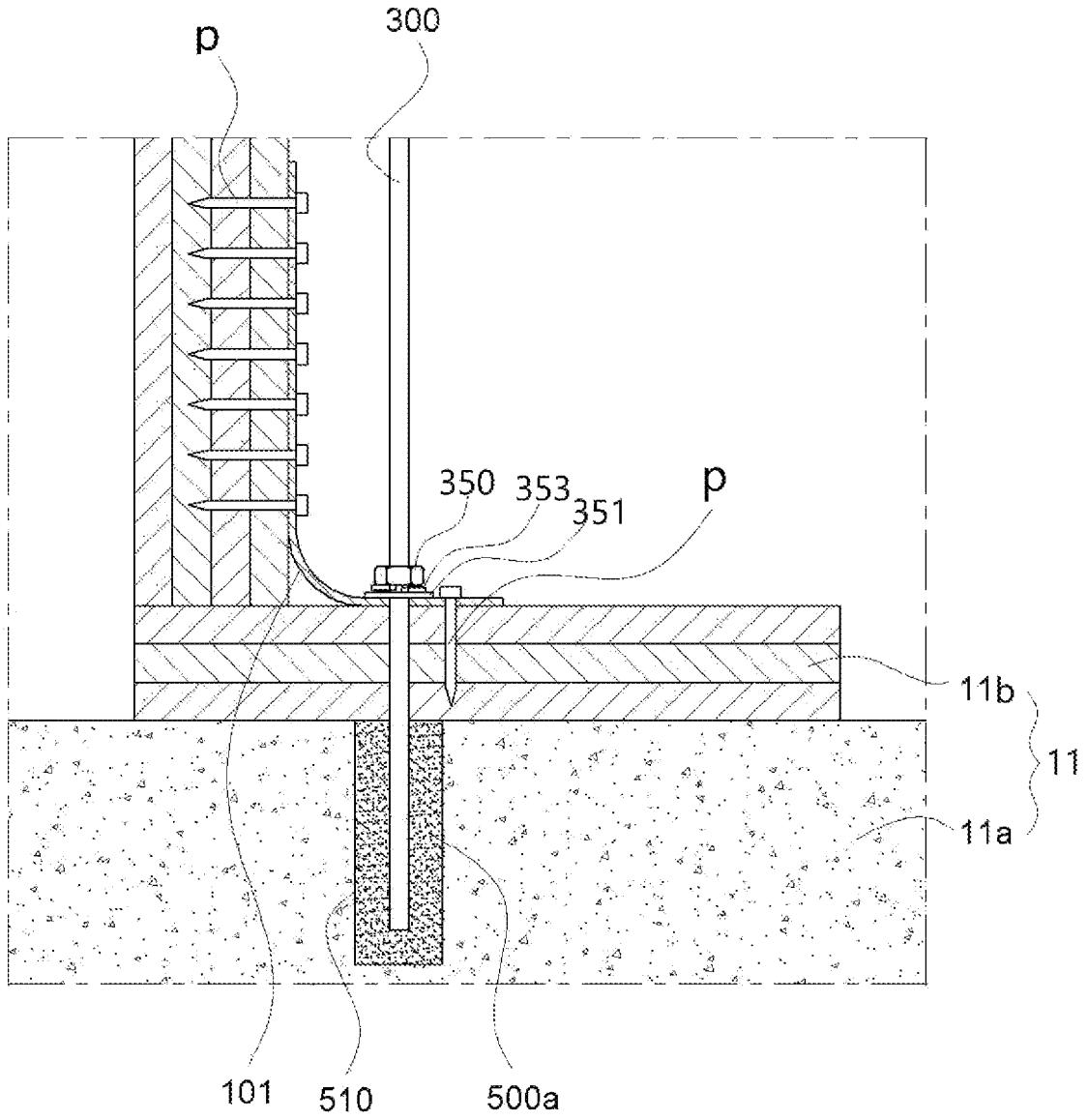
FIG. 6 is a side cross-sectional view showing the appearance of the anchor used when applying the seismic reinforcement structure according to a preferred embodiment of the present disclosure to a pre-built building.

Referring briefly to FIG. 6, the pieces p respectively inserted into the piece holes 120 are galvanized wood pieces, are formed with a diameter of 0.06L3 or more and 0.07L3 or less, and are formed to have a length of 0.8 times or more and 0.9 times or less the thickness of the second bottom layer 11*b*. For example, when L3 is 90 mm and the second bottom layer 11*b* is formed in a thickness of 126 mm, the piece p has a diameter of 5.4 mm or more and 6.3 mm or less, and is formed in a length of 100.8 mm or more and 113.4 mm or less. Preferably, it is formed with a diameter of 6 mm, and it is more preferably formed to have a length of 112 mm.

The connecting support rod 300 is formed in a vertically long shape as shown in FIG. 4, and the outer surface thereof is a rod-shape formed with a male screw, and vertically connects the horizontal part of the first bracket 101 and the second bracket 103. The connecting support rod 300 is installed as described above, and serves to keep a constant distance between the bottom 11 and the ceiling 15 when a vertical vibration is applied to the building 10.

Figure 5:
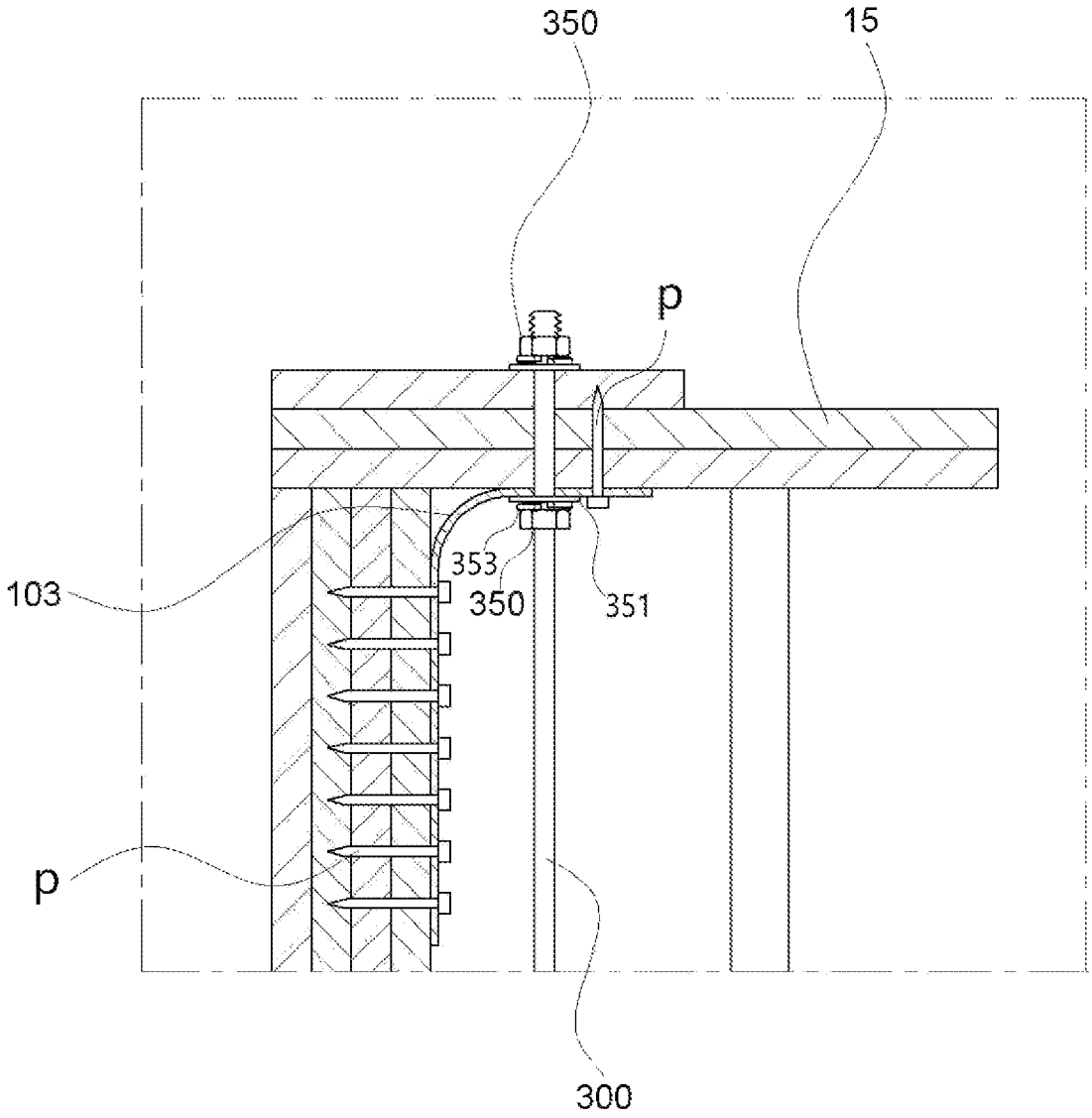
FIG. 5 is a partial side cross-sectional view showing a state in which the upper end of the connecting support rod included in the seismic reinforcement structure according to a preferred embodiment of the present disclosure is fixed to the ceiling.

FIG. 5 is a partial side cross-sectional view showing a state in which the upper end of the connecting support rod included in the seismic reinforcement structure according to a preferred embodiment of the present disclosure is fixed to the ceiling.

As shown in FIG. 5, the connecting support rod 300 is configured so that the upper end penetrates through the through hole 111 and the ceiling 15 of the second bracket 103. In order to prevent the connecting support rod 300 from being detached from the through hole 111 of the second bracket 103 and the ceiling 15, nuts 350 are provided and fixed on the upper side and the lower side of the ceiling 15 at the part penetrating the ceiling 15 and the second bracket 103 of the connecting support rod 300. At this time, a flat washer 351 is inserted between the nut 350 and the ceiling 15 so as to be in contact with the ceiling 15. The flat washer 351 and the nut 350 are provided, and a spring washer 353 is again inserted therebetween. The flat washer 351 serves to fix the connecting support rod 300 in the through hole to reduce the movement, and the spring washer 353 prevents the nut 350 and the flat washer 351 from sliding, prevents the nut 350 from loosening, and adjusts a clearance of the connecting support rod 300 and controls a horizontal gap between the bottom and the ceiling 15.

The lower end of the connecting support rod 300 may be fixed to the bottom 11 in two ways.

FIG. 6 is a side cross-sectional view showing the appearance of the anchor used when applying the seismic reinforcement structure according to a preferred embodiment of the present disclosure to a pre-built building.

First, referring to FIG. 6, the coupling relationship and structure of the lower end of the connecting support bar 300 when applying the seismic reinforcement structure according to the preferred embodiment of the present disclosure to a pre-built building will be described. As shown in FIG. 6, an anchor groove 510 is formed inside the bottom on the lower side of the first bracket 101. At this time, the anchor groove 510 is deeply formed until it reaches the inside of the first bottom layer 11*a*. The inside of the anchor groove 510 is filled with a chemical anchor 500*a* which is a liquid at the time of construction, but is hardened to change phase to solid after construction. The lower end of the connecting support rod 300 is inserted into the anchor groove 510 through the through hole 111 of the first bracket 101. In other words, as the chemical anchor 500*a* is hardened, the lower end of the connecting support rod 300 is completely adhered to the chemical anchor 500*a*, and is fixed to the bottom 11 so as not to be easily detached. In addition, similarly to the upper end of the connecting support rod 300, the connecting support rod 300 through the through hole of the bracket 101 is provided with a nut 350, which is screwed to the male screw formed on the outer periphery of the connecting support rod 300. A flat washer 351 is inserted between the nut 350 and the bracket 101 to be in contact with the bracket 101, and a spring washer 353 is inserted between the flat washer 351 and the nut 350.

Figure 7:
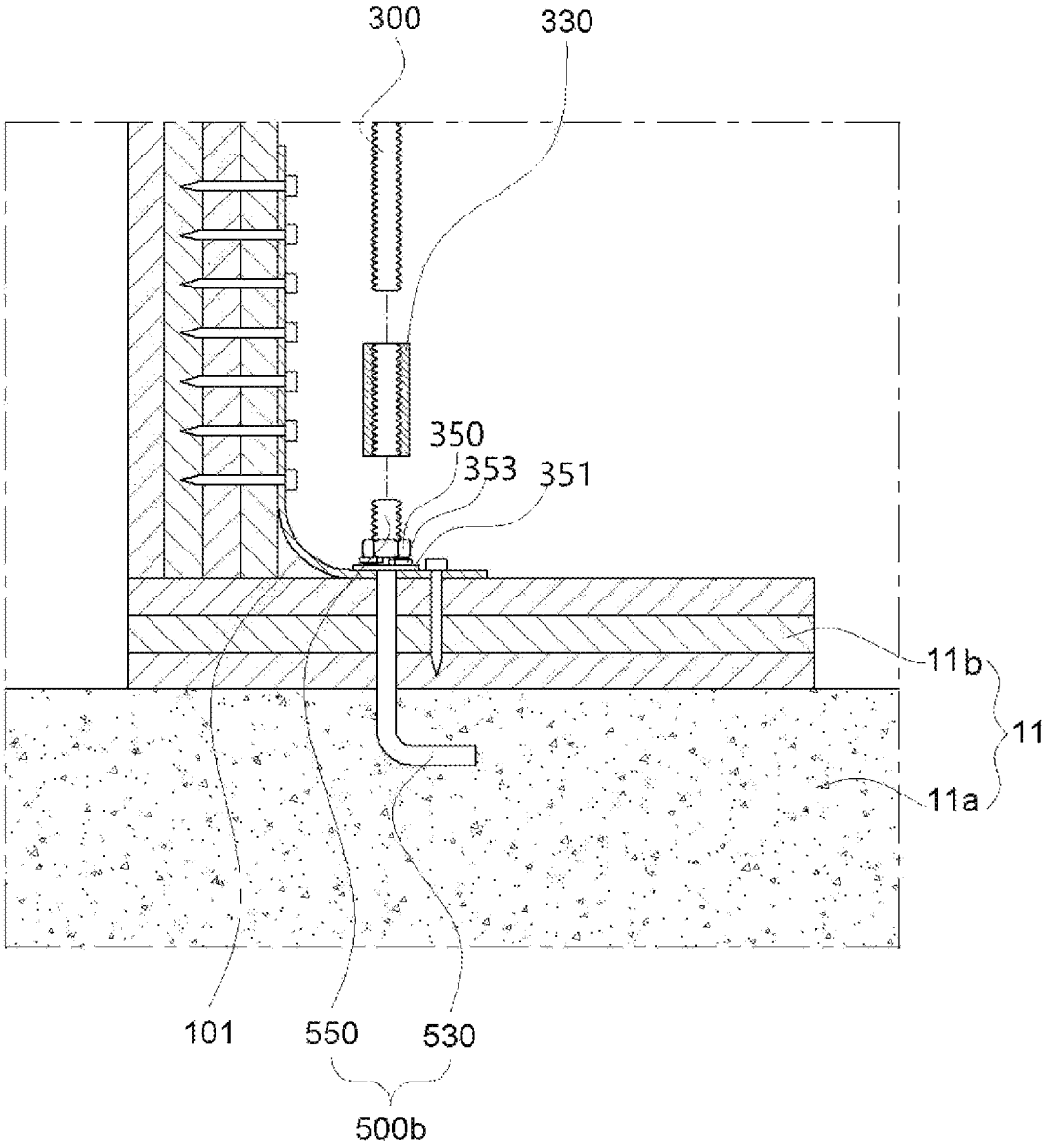
FIG. 7 is a side cross-sectional view showing the appearance of the anchor used when applying the seismic reinforcement structure according to a preferred embodiment of the present disclosure to a newly built building.

FIG. 7 is a side cross-sectional view showing the appearance of the anchor used when applying the seismic reinforcement structure according to a preferred embodiment of the present disclosure to a newly built building.

The coupling relationship and structure of the lower end of the connecting support rod 300 when the seismic reinforcement structure according to the preferred embodiment of the present disclosure is applied to a newly built building will be described with reference to FIG. 7. As shown in FIG. 7, an anchor 500*b* includes an insertion part 530 extending approximately in the left-right direction to have a predetermined shape, wherein a protrusion 550 extends upward from the insertion part 530. At this time, the insertion part 530 is welded and fixed to the steel reinforcement arranged inside the first bottom layer 11*a*, and is embedded in the first bottom layer 11*a*. The protrusion 550 penetrates through the second bottom layer 11*b* and passes through the through hole 111 provided in the first bracket 101 to protrude upwardly from the bottom 11. A male screw is formed on the outer peripheral surface of the protruded upper end. The flat washer 351, the spring washer 353 and the nut 350 are sequentially coupled to the upper end of the bottom 11 of the protrusion 550, and then the connecting support rod 300 is connected through a connector 330. The connector 330 is in the form of a tube, has a female screw formed on the inner peripheral surface, wherein an upper end of the protrusion 550 is screwed to a lower part thereof, and a lower end of the connecting support rod 300 is screwed to an upper part thereof.

The connecting support rod 300 and the anchor 500*b* are fixed to the bottom 11 through the coupling structure as described above, like a root of a tree in the event of an earthquake, thereby exhibiting the effect of not easily collapsing the building.

On the other hand, the bracket 100 and the connecting support rod 300 has a coupling relationship as described above, but can be implemented in different shapes.

Figure 8:
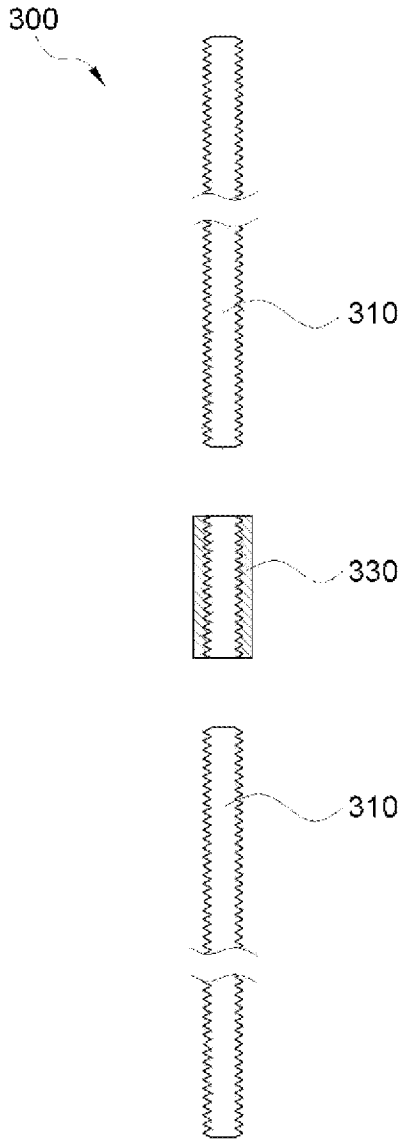
FIG. 8 is an assembly view showing the configuration of each part of the connection support rod included in the seismic reinforcement structure according to another embodiment of the present disclosure.

FIG. 8 is an assembly view showing the configuration of each part of the connection support rod included in the seismic reinforcement structure according to another embodiment of the present disclosure.

Since the wall surface height of the building 10 are not all uniformly formed, the length of the connecting support rod 300 is also varied. In order to solve this problem, the connecting support rod 300 may include a plurality of screw rods 310 and at least one connector 330. The connector 330 has the same shape as the connector described above, wherein different screw rods 310 are respectively coupled to the upper part and the lower part so that they can be connected to each other one after another. That is, the entire length of the connecting support rod 300 can be adjusted via the connector 330. In a state in which the connecting support rod 300 is fixed to the ceiling and the bottom, the insertion degree of the screw rod 310 inserted into the inside of the connector 330 is adjusted, so that the effect capable of adjusting the tension applied by the connecting support rod 300 can be exerted.

Figure 9:
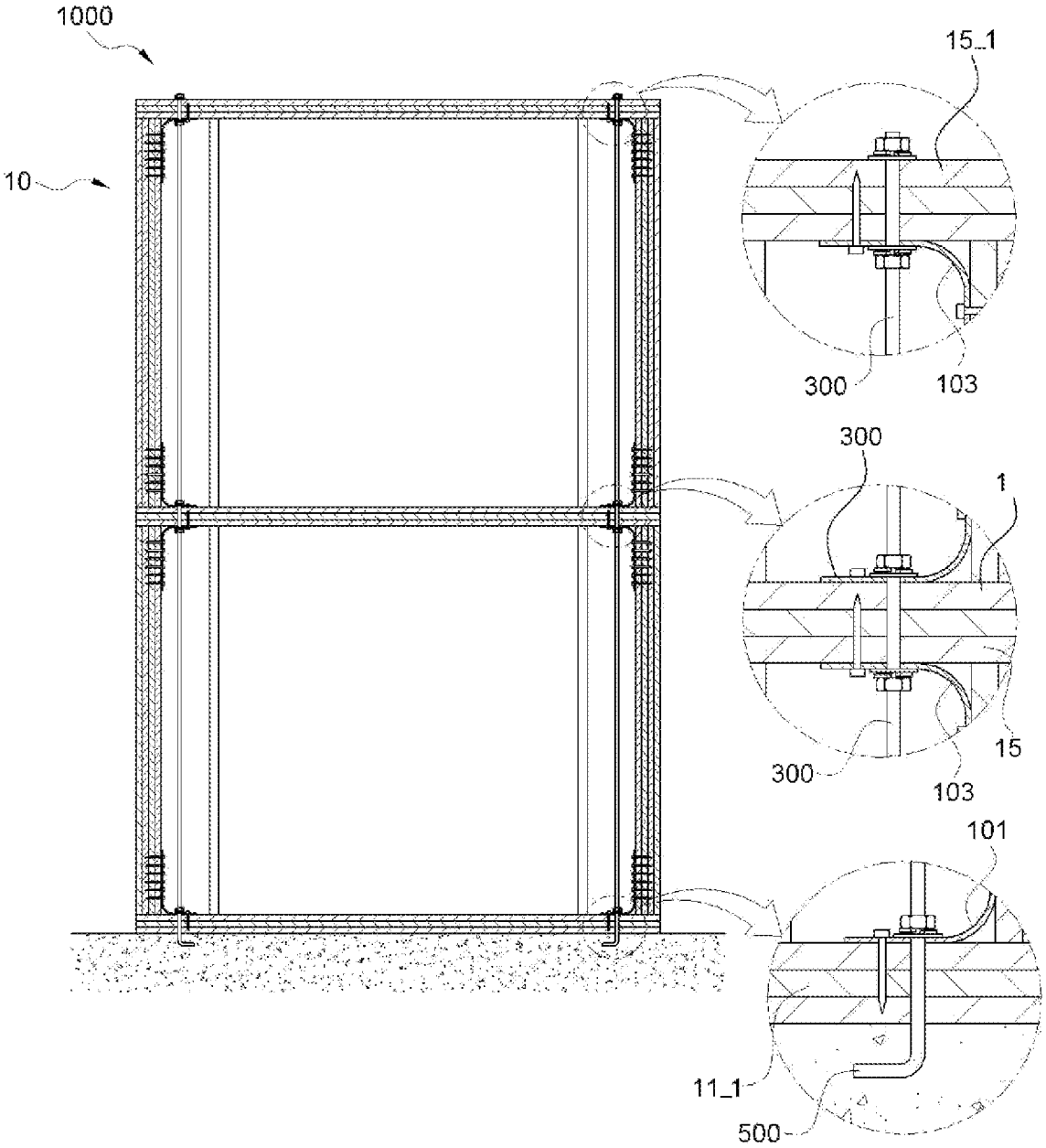
FIG. 9 is a side cross-sectional view illustrating a case where a building to which an seismic reinforcement structure according to a preferred embodiment of the present disclosure is applied has a multi-layer structure.

FIG. 9 is a side cross-sectional view illustrating a case where a building to which an seismic reinforcement structure according to a preferred embodiment of the present disclosure is applied has a multi-layer structure.

When the building to which the seismic reinforcement structure according to the preferred embodiment of the present disclosure is applied has a multi-layer structure including two or more layers, the first bracket 101 and the second bracket 103 are installed on each floor as shown in FIG. 9. At this time, the through holes of the first bracket 101 and the second bracket 103 installed on each floor are arranged on the same line each other in the vertical direction. And the connecting support rod 300 penetrates through a second bracket 103 in which the upper end is installed on the uppermost layer, and is fixed to the ceiling (15_1) of the uppermost layer and the lower end is fixed to the anchor 500 provided at the bottom (11_1) of the lowermost layer. In addition, the central part of the connecting support rod 300 is coupled so as to penetrate through the remaining brackets 101 and 103 excluding the second bracket 103 and the ceiling 15_1 of the uppermost layer and the first bracket 101 and the bottom 11_1 of the lowermost layer. Further, before and after the penetration of the bottom 11 or the ceiling 15 of the central part of the connecting support rod 300, a flat washer, a spring washer, and a nut 350 are coupled to the outer periphery of the connecting support rod 300 to fix the position of the connecting support rod 300, thereby reducing vibration generated from the connecting support rod 300 at the penetrating portion of the ceiling 15 or the bottom 11.

[Seismic Retrofitting Method]

Hereinafter, the seismic retrofitting method according to a first embodiment of the present disclosure will be described in detail. Since the seismic retrofitting method described below is a sequential method of forming the seismic reinforcement structure described above, configurations having the same names or reference numerals as those described above are considered to be the same.

Step 1) is to arrange a steel reinforcement to be included in a bottom 11 of the building 10. In this case, the steel reinforcements may be arranged after excavating the ground to a predetermined width, and a plurality of the steel reinforcements are arranged in a grid on a plane horizontal to the ground, but the contact points of different steel reinforcements that are crossed and met can be welded.

Step 2) is to fix an insertion part 530 to the steel reinforcement so that the protrusion 550 of the anchor 500*b* protrudes at a position where the first bracket 101 is installed. As shown in FIG. 6, it is desirable that the insertion part 530 of the anchor 500*b* is formed in the horizontal direction, and welded and fixed to the steel reinforcement arranged in the horizontal direction.

Step 3) is to place concrete so that the steel reinforcement and the insertion part 530 are embedded, thereby forming a first bottom layer 11*a* of the building 10. Here, the first bottom layer 11*a* is further laminated with a second bottom layer 11*b* made of lightweight wood as the upper side of the first bottom layer made of concrete, and the protrusion 550 protrudes on the upper side of the bottom 11.

Step 4) is to form the wall surface 13 and the ceiling 15 on the upper side of the bottom to construct a building 10. At this time, any one portion of the wall surface is formed to erect within a predetermined radius from the protrusion 550.

Step 5) is to insert the protrusion 550 into a through hole 111 formed in the horizontal part 110 of the first bracket 101, then fixing the first bracket 101 to the bottom 11 and the wall surface 13, and fixing the second bracket 103 to the ceiling 15 and the wall surface 13 so as to face the first bracket 101. As described above, the through hole 111 formed in the second bracket 103 is positioned to be arranged on the same line in the vertical direction as the through hole 111 formed in the first bracket 101, and then fixed to the ceiling 15 and the wall surface 13.

Step 6 is to penetrate and fix an upper end of the connecting support rod 300 to the horizontal part 110 and the second bracket 103 and the ceiling 15, and connecting a lower end of the connecting support rod 300 to the protrusion 550. In a method of fixing the upper end of the connecting support rod 300 to the ceiling 15, a nut 350 can coupled and fixed to the upper end of the connecting support rod 300 protruding through the ceiling 15, and in a method of connecting the lower end of the connection support rod 300 to the protrusion 550, the connection can be made using the connector 330.

Step 7) is completed by adjusting the connector 330 and the screw rod 310 included in the connecting support rod 300 to adjust the tension and length of the connecting support rod 300.

The above-described steps describe the first embodiment when the building 10 has a single-story structure. When the building 10 has a multi-layer structure, some of the steps described above may be modified. In the following, each of the modified steps will be described.

In step 4), a wall surface, a ceiling 15 and a bottom 11 are additionally constructed on the upper side of the bottom so as to correspond to the number of floors included in the building 10. In this case, the remaining floors excluding the uppermost floor and the lowermost floor may be configured so that at the lower floor and the upper floor disposed adjacent to each other, the ceiling of the lower layer is the same surface as the bottom of the upper layer.

In step 5), the first bracket 101 and the second bracket 103 are fixed at a position facing each other on each floor, but the first bracket 101 and the second bracket 103 included in each floor is arranged on the same line each other, and in the case of the lowermost floor, the protrusion 550 is inserted into a through hole 111 formed in a horizontal part of the first bracket 101. The through-holes 111 formed in the first bracket 101 and the second bracket 103 installed in each floor are arranged on the same line in the vertical direction for insertion of the connecting support rod 300.

In step 6), the upper end of the connecting support rod 300 is fixed through the horizontal part 110 of the second bracket 103 and the ceiling 15_1 of the uppermost floor, and the lower end of the connecting support rod 300 is connected to the protrusion 550 protruded on the upper side of the bottom of the lowermost floor. For reference, when the building 10 is a multi-layer, it goes without saying that the anchor 500 is not provided for the penetration of the connecting support rod 300 at the remaining bottom excluding the lowest floor.

Hereinafter, the seismic retrofitting method according to a second embodiment of the present disclosure will be described in detail. The seismic retrofitting method according to a second embodiment of the present disclosure relates to a method for additionally constructing a seismic reinforcement structure in a built building.

Step a) is to form an anchor groove 510 by drilling a position where the first bracket 101 is installed at the bottom 11 of the building 10. The position where the first bracket 101 is installed is preferably formed within a predetermined radius from a portion where the bottom 11 and the wall surface 13 are connected to each other. In this case, the predetermined radius will be a range within the length in the first direction of the bracket 100

Step b) is to inject a liquid chemical anchor 500*a* into the anchor groove 510.

Step c) is to fix the first bracket 101 to the bottom and the wall surface, and fix the second bracket 103 to the ceiling 15 and the wall surface 13 so as to face the first bracket 101. At this time, the fixing of the second bracket 103 may be performed by changing the order at any time before the step e) described later.

Step d) is to insert a lower end of the connecting support rod 300 into the anchor groove 510 through a horizontal part 110 of the first bracket 101 and hardening the chemical anchor 500*a*. At this time, the connecting support rod 300 is connected vertically to the bottom 11.

Step e) is to fix the upper end of the connecting support rod 300 through the horizontal part 110 of the second bracket 103 and the ceiling 15. Similar to the first embodiment described above, the second embodiment can also perform the fixing by connecting a nut 350 to the upper end of the connecting support rod 300 protruding through the ceiling 15.

Step f) is completed by adjusting the screw rod 310 and the connector 330 included in the connection support rod 300 to adjust the tension and length of the connecting support rod 300.

When the second embodiment is a case where the building 10 has a multi-layer structure, some of the steps described above may be modified. In the following, each of the modified steps will be described.

In step a), an anchor groove 510 is formed only at the bottom 11_1 of the lowermost floor of the building 10.

In step c), the first bracket 101 and the second bracket 103 are fixed to positions facing each other on each floor, but the first bracket 101 and the second bracket 103 included in each floor are disposed on the same line each other in the vertical direction.

In step e), the upper end of the connecting support rod 300 is fixed through the horizontal part of the second bracket and the ceiling on the uppermost floor, and the ceiling 15 and the bottom 11 of the remaining floors excluding the ceiling 15_1 of the uppermost floor and the bottom 11_1 of the lowermost floor are coupled through the connecting support rod 300.

The technical spirit of the present disclosure should not be interpreted as being limited to the above-described embodiments. It goes without saying that the scope of application is varied, and various modifications can be made at the level of those skilled in the art without departing from the gist of the present disclosure as claimed in the claims. Therefore, such improvements and modifications fall within the protection scope of the present disclosure as long as those skilled in the art will be apparent.

EXPLANATION OF SYMBOLS

10: building
11: bottom 11_1: bottom of lowermost floor
11*a*: first bottom layer 11*b*: second bottom layer
13: wall surface
15: ceiling 15_1: ceiling of uppermost floor
100: bracket
101: first bracket 103: second bracket
110: horizontal part 111: through hole
120: piece hole 130: curved surface portion
150: vertical part
300: connecting support rod
310: screw rod 330: connector
350: nut 351: flat washer
353: spring washer
500: anchor 510: anchor groove
530: insertion part 550: protrusion
1000: seismic reinforcement structure
H: height of wall surface
L1: length in the first direction of the bracket
L2: length in the second direction of the bracket
L3: length in the third direction of the bracket
p: piece R: radius of curvature

The invention claimed is:

1. A seismic reinforcement structure of a wooden structure building comprising: a first bracket including a horizontal part extending in contact with a bottom surface of a floor of the building, and a vertical part extending in contact with a wall surface of the floor of the building; a second bracket including a horizontal part extending in contact with a ceiling of the floor of the building, and a vertical part extending in contact with the wall surface of the floor of the building; and an elongated support rod extending vertically and connecting the horizontal part of the first bracket to the horizontal part of the second bracket, wherein the elongated rod is substantially perpendicular to the horizontal parts, wherein each of the first bracket and the second bracket comprises a curved surface portion with a predetermined radius of curvature which connects the horizontal part and the vertical part, wherein a length of the horizontal parts are L1 and the vertical parts are L2 and the radius is R, and L2 is 1.5L1 to 4L1 and R is 0.1L1 to 0.5L1.

2. The seismic reinforcement structure according to claim 1, wherein the elongated support rod includes, a plurality of screw rods which are formed in a vertically long shape, have a male screw formed on the outer surface, and are arranged in succession to each other in the vertical direction, and a connector which has a tubular shape, has a female screw formed on an inner peripheral surface thereof, and is screw-coupled by the screw rod arranged in succession to each other at both ends, so that the length and tension can be adjusted.

3. The seismic reinforcement structure according to claim 1, wherein the elongated support rod, vertically penetrates the horizontal parts of the first bracket and the second bracket, and a ceiling of the building, so that an upper end is fixed to the ceiling and a lower end is inserted into a bottom surface of the building, and the seismic reinforcement structure, is provided so as to surround a lower end of the elongated support rod at a portion where the lower end of the elongated support rod of the bottom of the building is inserted, and further includes an anchor for fixing the connecting support rod.

4. The seismic reinforcement structure according to claim 1, wherein the seismic reinforcement structure further includes, an anchor composed of an insertion part having a predetermined shape and embedded in the bottom, and a protrusion extending upwardly from the insertion part and vertically protruding the first bracket to protrude upwardly from the bottom surface, and the elongated support rod vertically penetrates, a horizontal part of the second bracket and a ceiling of the building, so that an upper end is fixed to the ceiling and a lower end is connected to the upper part of the protrusion portion.

5. The seismic reinforcement structure according to claim 3, wherein the building includes two or more floors, the first bracket and the second bracket being installed on each floor, and the elongated support rod is configured so that the upper end penetrates the second bracket of the uppermost floor and is fixed to the ceiling, the lower end is fixed to the anchor provided at the bottom of the lowermost floor, and the a central part penetrates at least the brackets excluding the second bracket of the uppermost floor and the first bracket of the lowermost floor.

6. The seismic reinforcement structure according to claim 4, wherein the building includes two or more floors, the first bracket and the second bracket being installed on each floor, and the elongated support rod is configured so that the upper end penetrates the second bracket of the uppermost floor and is fixed to the ceiling, the lower end is fixed to the anchor provided at the bottom of the lowermost floor, and a central part penetrates at least the brackets excluding the second bracket of the uppermost floor and the first bracket of the lowermost floor.

7. A seismic retrofitting method for constructing the seismic reinforcement structure according to claim 5, the method comprising the steps of: 1) arranging a steel reinforcement to be included in a bottom of the building; 2) fixing an insertion part to the steel reinforcement so that the protrusion of the anchor protrudes at a position where the first bracket is installed; 3) placing concrete so that the steel reinforcement and the insertion part are embedded, thereby forming the bottom of the building; 4) forming the wall surface and the ceiling on the upper side of the bottom to construct a building; 5) inserting the protrusion into a through hole formed in the horizontal part of the first bracket, then fixing the first bracket to the bottom and the wall surface, and fixing the second bracket to the ceiling and the wall surface so as to face the first bracket; and 6) penetrating and fixing an upper end of the elongated support rod to the horizontal part of the second bracket and the ceiling, and connecting a lower end of the elongated support rod to the protrusion.

8. A seismic retrofitting method for constructing the seismic reinforcement structure according to claim 6, the method comprising the steps of. 1) arranging a steel reinforcement to be included in a bottom of the building; 2) fixing an insertion part to the steel reinforcement so that the protrusion of the anchor protrudes at a position where the first bracket is installed; 3) placing concrete so that the steel reinforcement and the insertion part are embedded, thereby forming the bottom of the building; 4) forming the wall surface and the ceiling on the upper side of the bottom to construct a building; 5) inserting the protrusion into a through hole formed in the horizontal part of the first bracket, then fixing the first bracket to the bottom and the wall surface, and fixing the second bracket to the ceiling and the wall surface so as to face the first bracket; and 6) penetrating and fixing an upper end of the elongated support rod to the horizontal part of the second bracket and the ceiling, and connecting a lower end of the elongated support rod to the protrusion.

9. The seismic retrofitting method according to claim 7, wherein the building includes two or more floors; in step 4), a wall surface, a ceiling and a bottom are additionally constructed on the upper side of the bottom so as to correspond to the number of floors included in the building; in step 5), the first bracket and the second bracket are fixed at a position facing each other on each floor, but the first bracket and the second bracket included in each floor is arranged on the same line each other, and in the case of the lowermost floor, the protrusion is inserted into a through hole formed in a horizontal part of the first bracket; and in step 6), the upper end of the elongated support rod is fixed through the horizontal part of the second bracket and the ceiling of the uppermost floor, and the lower end of the elongated support rod is connected to the protrusion of the lowermost floor.

10. The seismic retrofitting method according to claim 8, wherein the building includes two or more floors; in step 4), a wall surface, a ceiling and a bottom are additionally constructed on the upper side of the bottom so as to correspond to the number of floors included in the building; in step 5), the first bracket and the second bracket are fixed at a position facing each other on each floor, but the first bracket and the second bracket included in each floor is arranged on the same line each other, and in the case of the lowermost floor, the protrusion is inserted into a through hole formed in a horizontal part of the first bracket; and in step 6), the upper end of the elongated support rod is fixed through the horizontal part of the second bracket and the ceiling of the uppermost floor, and the lower end of the elongated support rod is connected to the protrusion of the lowermost floor.

11. A seismic retrofitting method for constructing the seismic reinforcement structure according to claim 1, the method comprising the steps of: a) forming an anchor groove by drilling a position where the first bracket is installed at the bottom of the building; b) injecting a liquid chemical anchor into the anchor groove; c) fixing the first bracket to the bottom and the wall surface, and fixing the second bracket to the ceiling and the wall surface so as to face the first bracket; d) inserting a lower end of the elongated support rod into the anchor groove through a horizontal part of the first bracket and solidifying the chemical anchor; and e) fixing the upper end of the elongated support rod through the horizontal part of the second bracket and the ceiling.

12. The seismic retrofitting method according to claim 11, wherein the building includes two or more floors, in step a), an anchor groove is formed only at the bottom of the lowermost floor of the building, in step c), the first bracket and the second bracket are fixed to positions facing each other on each floor, but the first bracket and the second bracket included in each floor are disposed on the same line each other, and in step e), the upper end of the elongated support rod is fixed through the horizontal part of the second bracket and the ceiling on the uppermost floor.

* * * * *